United States Patent [19]

Loqvist

[11] 4,235,691

[45] Nov. 25, 1980

[54] APPARATUS FOR ELECTROPLATING AN OUTER SURFACE OF A WORKPIECE

[75] Inventor: Kaj-Ragner Loqvist, Fagersta, Sweden

[73] Assignee: Wave Energy Development I Vastmanland Aktiebolag, Fagersta, Sweden

[21] Appl. No.: 50,456

[22] Filed: Jun. 20, 1979

[30] Foreign Application Priority Data

Jun. 30, 1978 [SE] Sweden ..... 7807399

[51] Int. Cl.[3] ..... C25D 17/00; C25D 17/12

[52] U.S. Cl. ..... 204/212; 204/272

[58] Field of Search ..... 204/212, 215, 217, 272

[56] References Cited

U.S. PATENT DOCUMENTS

| | | | |
|---|---|---|---|
| 1,927,162 | 9/1933 | Fiedler | 204/26 |
| 3,022,232 | 2/1962 | Bailey | 204/217 |
| 3,720,595 | 3/1973 | Kohler | 204/272 |
| 3,804,725 | 4/1974 | Haynes | 204/26 |

FOREIGN PATENT DOCUMENTS

| | | | |
|---|---|---|---|
| 2803113 | 8/1978 | Fed. Rep. of Germany | 204/26 |
| 318637 | 12/1971 | U.S.S.R. | 204/26 |

*Primary Examiner*—T. M. Tufariello

*Attorney, Agent, or Firm*—Larson, Taylor and Hinds

[57] ABSTRACT

A method and apparatus of forming a layer of a metal or metal alloy on the surface of a workpiece by means of electrolytic plating, the workpiece being used as the anode. An electrolyte containing ion of at least one metal with which the workpiece is to be coated is caused to move by means of a resilient and electrically insulating material which is arranged on the anode and which is brought into contact with and adapts to the surface of the workpiece and is caused to move relative to said surface in a manner such that electrolyte and gases formed in said electrolyte are conveyed away at said surface and a low electrolyte temperature is maintained. The anode covers the surface of the workpiece to be coated and carries a resilient and electrically insulating material which divides the space between the workpiece and the anodes into cavities and acts as an electrolyte and gas conveyor and is in contact with the surface to be coated.

4 Claims, 3 Drawing Figures

APPARATUS FOR ELECTROPLATING AN OUTER SURFACE OF A WORKPIECE

The present invention relates to a method and an apparatus for applying a layer of a metal or a metal alloy to a surface of an article made of metal or a metal alloy, for example a surface of a steel wire, a turbine blade, sheetmetal, metal strip and pipes.

In known electroplating techniques or in known chemical plating techniques for plating the surface of wire, pipes and strip materials, the article to be plated, i.e. the workpiece, is introduced into an electrolytic bath and the coating metal is precipitated electrolytically or chemically. One disadvantage with chemical plating is that the thickness to which the layer can be applied is limited. One disadvantage with electroplating is that a thicker layer is obtained on those surfaces located nearest the anode and, moreover, that the current density must be maintained beneath a given level, since otherwise excessive quantities of gas are developed.

A further known plating method is the brush-plating method, which is about 30 times faster than the two plating methods aforementioned. In the case of brush-plating there is used a graphite anode which is insulated with long-fibred polypropylene wool, which is dipped into an electrolyte and the anode passed over the workpiece to be plated. The rate at which plating can be carried out is restricted by the strong development of heat and gas. Another disadvantage with the brush-plating method is that a layer of varying thickness is obtained, owing to the fact that part of the anode covers the workpiece to be plated. An object of the present invention is to provide a method and an apparatus for the electroplating of workpieces, which provide a dense and well adhering surface layer to such articles as steel wire, the helices of rock-drill shafts etc., and which at the same time, increase the fatigue strength and resistance to corrosion of the plated articles, as well as increasing the wear strength and reducing the frictional resistance of said articles.

The characterizing features of the invention are disclosed in the following claims.

In comparison with surface layers obtained with earlier known electroplating methods, the surface layer obtained by means of the present invention affords, inter alia, better protection against corrosion and an improved fatigue strength. The basic concept of the method according to the invention is based on the use of a novel type of resilient and electrically non-conductive material which acts as a conveyor of electrolyte and of the gases formed in the electrolyte bath. According to the invention, very small quantities of electrolyte are required, which is an advantage, inter alia, from the aspect of environmental care. Furthermore, the electrolyte does not bind to the electrolyte-carrying material, i.e. it will not collect in pockets and be stationary, as is the case, for example, when the electrolyte carrier is cotton wool. The invention allows the rate of flow of the electrolyte to be greatly increased, so that good cooling is obtained, thereby allowing the coating rate to be considerably increased compared with known methods. For example, the coating rate can be increased about 70 times, in comparison with bath plating, which, moreover, results in a poor surface layer as a result of hydrogen enbrittlement. The method according to the invention also differs from the brush-plating method by the fact that not only do the cathode and anode move relative to one another but that the electrolyte is moved strongly against the anode and cathode, owing to the fact that the resilient and electrically non-conductive material acts as an electrolyte and gas conveyor. The advantages afforded hereby include strong cooling by constant replacement of the electrolyte, which provides for a high current density and therewith a higher rate of precipitation than with conventional methods. The metal layer is extremely dense and uniform, which increases the strength of the layer.

The invention will be described hereinafter in more detail with reference to the accompanying schematic drawings which illustrate an exemplary embodiment of the invention.

Figure 1:
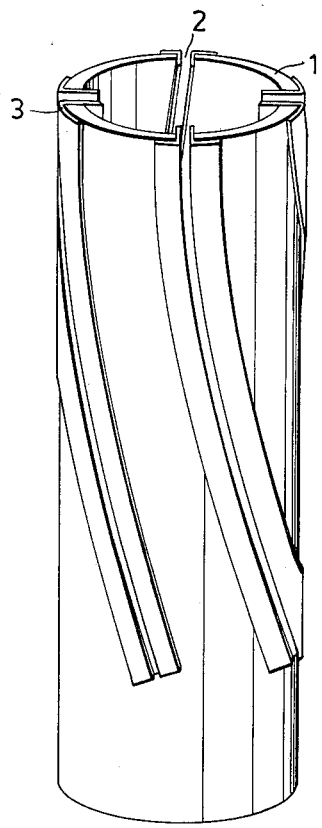
FIG. 1 illustrates a plating head or an anode in an apparatus according to the invention.
Figure 2:
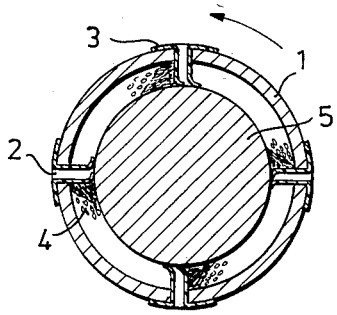
FIG. 2 is a cross-sectional view of the plating head illustrated in FIG. 1, an object to be plated being inserted in the head.

The plating head illustrated in FIG. 1 comprises an anode body 1 provided with four slots 2 which extend in a spiral form and in which are arranged strips 3 of an insulating, rigid and resilient material, such as a plastics material. The strips 3 are suitably perforated at least in that part thereof which extends into the tubular anode body 1. FIG. 2 illustrates how an object 5 to be plated on a surface thereof is inserted in the plating head 1. It will be seen that the strips 3 lie against the surface of the object or workpiece 5, there being formed a cavity 4 between the strips 3. Gas bubbles occurring during a plating operation are collected in the cavities 4 and are conveyed by the helically extending strips 3 as a result of rotation of the anode or the plating head 1 relative to the workpiece 5, which may be, for example, a steel wire. The supply of electrolyte is adapted in a manner such as not to completely feel the cavities 4, since there is a risk that pressure from the formed gas bubbles will force the electrolyte away, interrupting the plating operation. This condition is extremely important in order that a high plating rate can be obtained at a high current density. The cavities 4 are thus an essential characteristics of the invention and have enabled the plating rate to be increased by 20 times in comparison with brush-plating methods and a hundred times in comparison with bath plating methods.

Figure 3:
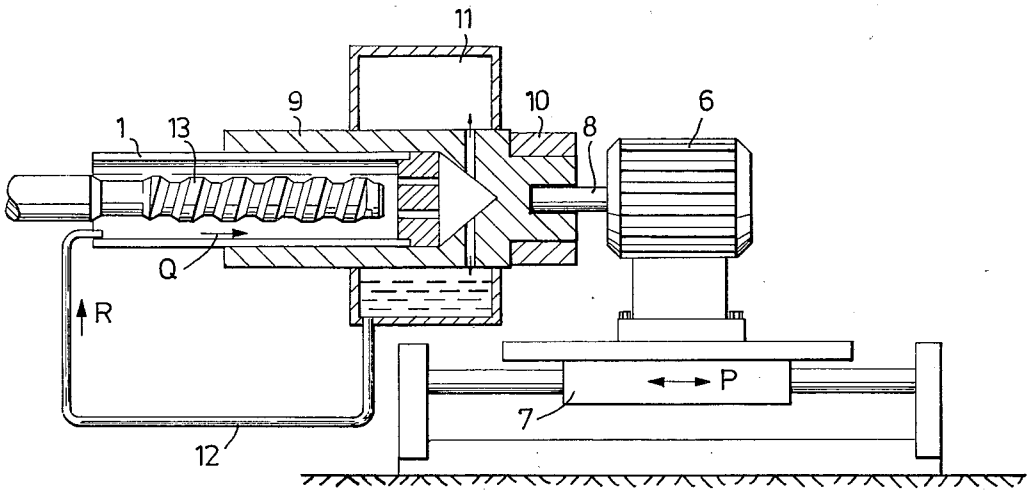
FIG. 3 shows an apparatus according to the invention and illustrates the plating of the helices of a rock-drill shaft.

The apparatus illustrated in FIG. 3 comprises an electric motor 6 which is mounted on a slide 7 arranged for reciprocatory movement, as illustrated by the arrow P. The motor 6 is connected to a rotatable cylinder 9 through a shaft 8, the plating head or anode 1 of FIGS. 1 and 2 being arranged inside said cylinder. Upon rotation of the cylinder 9 and during reciprocatory oscillation of the cylinder together with the motor 6, the gas or slime formed during a plating operation is conveyed in the direction of the arrow Q. Current is supplied to the anode 1 over a collector 10. Arranged around the cylinder 9 is a collecting vessel 11 which seals against the cylinder and from which electrolyte is lead through a line 12 in the direction of arrow R into the tubular anode 1. The apparatus illustrated in FIG. 3 is particularly suited for plating the end portions of elongate objects, for example the helices 13 of a rock-drill shaft, as in the illustrated case. When, for example, the surfaces of steel wire are to be plated, there is used instead a plating head which is open at both ends and which is caused to move solely in a rotary movement around the long axis of the wire whilst continuously moving the wire through the head. When using a plating head which is open at both ends, the motor 6 is arranged on one side of the head, the rotary movement being transmitted to the head by means of a bevelled gear. In this case, the thickness of the coating and the plating rate are dependent upon the length of the plating head and on the speed at which the wire is passed through the head. In this instance, the cylinder corresponding to the cylinder 9 is, similar to the anode 1, open at both ends and may be surrounded by an electrolytecollecting vessel corresponding to the vessel 11 of FIG. 3, such that electrolyte can be conveyed in principle in the same manner as with the apparatus shown in FIG. 3.

When plating the outer layer of sheet metal and other planar workpieces, there is used a plating head which, in principle, is similar to the plating head showed in FIG. 1, although in this case the anode used is a tube of large diameter and of relatively small wall thickness so that the tube can be readily bent and, for example, two rollers may be arranged in spaced apart relationship around the tube, of which rollers one is driven. The tube is deformed in a manner such that, in principle, it resembles the track of a track-driven tractor. That part of the tube which lies between the rollers is in abutment with the strip or sheet to be plated. The strip or plate can be moved continuously in the manner of the aforementioned wire. When plating strip and sheet it is also possible for the anode to have the form of a plate arranged within a grid-like frame of insulating material which is driven in the same manner as the anode described above, i.e. in accordance with the same principle as the tracks of a track-driven tractor. This grid-like frame is therefore provided with strips corresponding to the strips 3 illustrated in FIG. 1. This anode thus lies substantially flat against the strip or plate and remains stationary, although sufficient space is found between the anodes and the plate or strip through which the grid-like frame together with the electrolyte and gas conveying strips can pass through.

What I claim is:

1. An apparatus for providing a surface coating of metal or metal alloy upon the surface of a workpiece through electrolytic plating, the workpiece being used as a cathode, characterized by a tubular anode which is displaceable and rotatable in relation to the workpiece and which carries fastened in slots in its inner surface at least one resilient and electrically insulating strip of material which projects into the tube and makes contact with the workpiece during use dividing the space between workpiece and anode into separate cavities.

2. An apparatus according to claim 1, characterized in that the anode comprises a tubular member which is arranged around the workpiece and on which the resilient and electrically insulating material is arranged in helically formed slots such that said material projects into the tube and makes contact with the workpiece.

3. An apparatus according to claims 1 or 2, characterized in that the anode is made of stainless steel (9).

4. An apparatus according to claims 1 or 2, characterized in that the anode has a coating of metal thereon, such as a platina metal on copper.

* * * * *